US011127346B2

(12) United States Patent
Xuan

(10) Patent No.: US 11,127,346 B2
(45) Date of Patent: Sep. 21, 2021

(54) PIXEL CIRCUIT, DISPLAY SUBSTRATE AND DISPLAY DEVICE

(71) Applicant: BOE TECHNOLOGY GROUP CO., LTD., Beijing (CN)

(72) Inventor: Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 557 days.

(21) Appl. No.: 16/081,458

(22) PCT Filed: Jan. 31, 2018

(86) PCT No.: PCT/CN2018/074694
§ 371 (c)(1),
(2) Date: Aug. 31, 2018

(87) PCT Pub. No.: WO2019/019590
PCT Pub. Date: Jan. 31, 2019

(65) Prior Publication Data

US 2021/0183308 A1 Jun. 17, 2021

(30) Foreign Application Priority Data

Jul. 27, 2017 (CN) ..... 201710625962.X

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3266; G09G 3/3275; G09G 3/32; G09G 2300/0426;
(Continued)

(56) References Cited

U.S. PATENT DOCUMENTS

2005/0083270 A1 4/2005 Miyazawa
2012/0026146 A1 2/2012 Kim
(Continued)

FOREIGN PATENT DOCUMENTS

CN 1591104 A 3/2005
CN 101996579 A 3/2011
(Continued)

OTHER PUBLICATIONS

Office action from Indian Application No. 201847033182 dated Jan. 22, 2021.
(Continued)

*Primary Examiner* — Kenneth B Lee, Jr.
(74) *Attorney, Agent, or Firm* — Calfee, Halter & Griswold LLP

(57) ABSTRACT

A pixel circuit including a light emitting device; a driving circuit for controlling a magnitude of a driving current supplied from a first power supply to the light emitting device in response to a potential at a first node; a storage capacitor for causing a change in the potential at the first node in response to a change in a potential at a second node, where the potential at the second node may switch between a first reference voltage from a first reference power supply and a data voltage from a data line; and a compensation capacitor for suppressing a change in the driving current caused by a change in the first reference voltage. A display substrate and a display device are also provided.

16 Claims, 4 Drawing Sheets

(51) Int. Cl.
*G09G 3/3275* (2016.01)
*G09G 3/32* (2016.01)

(52) U.S. Cl.
CPC ..... *G09G 3/32* (2013.01); *G09G 2300/043* (2013.01); *G09G 2300/0426* (2013.01); *G09G 2300/0819* (2013.01); *G09G 2300/0852* (2013.01); *G09G 2300/0876* (2013.01); *G09G 2320/0209* (2013.01)

(58) Field of Classification Search
CPC ..... G09G 2300/043; G09G 2300/0819; G09G 2300/0852; G09G 2300/0876; G09G 2320/0209
See application file for complete search history.

(56) References Cited

U.S. PATENT DOCUMENTS

| | | | | |
|---|---|---|---|---|
| 2015/0348464 | A1 | 12/2015 | In et al. | |
| 2016/0163260 | A1* | 6/2016 | Takahashi ..... | G09G 3/3233 345/207 |
| 2016/0189635 | A1 | 6/2016 | Lee et al. | |
| 2016/0232840 | A1 | 8/2016 | Tseng et al. | |
| 2016/0267843 | A1 | 9/2016 | Wang et al. | |
| 2019/0057648 | A1 | 2/2019 | Xu | |

FOREIGN PATENT DOCUMENTS

| | | | |
|---|---|---|---|
| CN | 105206221 | A | 12/2015 |
| CN | 105989796 | A | 10/2016 |
| CN | 205828388 | U | 12/2016 |
| CN | 106710526 | A | 5/2017 |
| CN | 206194348 | | 5/2017 |
| CN | 206194348 | U | 5/2017 |
| CN | 106875893 | | 6/2017 |

OTHER PUBLICATIONS

Office action from Chinese Application No. 201710625962.X dated Aug. 14, 2020.
Search Report and Written Opinion for International Application No. PCT/CN2018/074694 dated Apr. 28, 2018.
Search Report from European Application No. 18758529.4 dated Mar. 9, 2021.

* cited by examiner

PIXEL CIRCUIT, DISPLAY SUBSTRATE AND DISPLAY DEVICE

RELATED APPLICATION

The present application is the U.S. national phase entry of PCT/CN2018/074694, with an international filing date of Jan. 31, 2018, which claims the benefit of Chinese Patent Application No. 201710625962.X, filed on Jul. 27, 2017, the entire disclosure of which is incorporated herein by reference.

FIELD

The present disclosure relates to the field of display technologies, and specifically to a pixel circuit, a display substrate and a display device.

BACKGROUND

In a display panel such as an organic light emitting diode display panel, parasitic capacitance (coupling capacitance) often exists between different wires due to limitation of layout design, and signal crosstalk thus occurs. When the level of a signal in a wire jumps, the level of a signal in another wire may also change, thereby affecting the display effect.

SUMMARY

According to an exemplary embodiment of the present disclosure, there is provided a pixel circuit comprising: a light emitting device; a driving circuit for controlling a magnitude of a driving current supplied from a first power supply to the light emitting device in response to a potential at a first node; a storage capacitor for causing a change in the potential at the first node in response to a change in a potential at a second node, wherein the potential at the second node is switchable between a first reference voltage from a first reference power supply and a data voltage from a data line; and a compensation capacitor for suppressing a change in the driving current caused by a change in the first reference voltage.

In some exemplary embodiments, the light emitting device is connected between the first power supply and a second power supply; the driving circuit comprises a driving transistor connected in series with the light emitting device, wherein the driving transistor has a gate connected to the first node; the storage capacitor is connected between the second node and the first node; and the compensation capacitor is connected between a third node and one of the first node and the second node.

In some exemplary embodiments, the driving transistor is a P-type transistor connected between the first power supply and the third node, and the light emitting device is connected between the third node and the second power supply.

In some exemplary embodiments, the driving transistor is an N-type transistor connected between the third node and the second power supply, and the light emitting device is connected between the first power supply and the third node.

In some exemplary embodiments, the pixel circuit further comprises: a reset circuit configured to supply the first reference voltage from the first reference power supply to the second node and supply a second reference voltage from a second reference power supply to the first node in response to a signal on a first scan line being active; a write circuit configured to supply the data voltage from the data line to the second node and bring the first node into conduction with the third node in response to a signal on a second scan line being active; and a light emission control circuit configured to, in response to a signal on a light emission control line being active, supply the first reference voltage from the first reference power supply to the second node and provide a path allowing the driving current to flow from the first power supply to the second power supply via the light emitting device and the driving transistor.

In some exemplary embodiments, the reset circuit comprises: a first transistor having a gate connected to the first scan line, a first electrode connected to the first reference power supply, and a second electrode connected to the second node; and a second transistor having a gate connected to the first scan line, a first electrode connected to the second reference power supply, and a second electrode connected to the first node.

In some exemplary embodiments, the write circuit comprises: a third transistor having a gate connected to the second scan line, a first electrode connected to the data line, and a second electrode connected to the second node; and a fourth transistor having a gate connected to the second scan line, a first electrode connected to the first node, and a second electrode connected to the third node.

In some exemplary embodiments, the light emission control circuit comprises: a fifth transistor having a gate connected to the light emission control line, a first electrode connected to the first reference power supply, and a second electrode connected to the second node; and a sixth transistor having a gate connected to the light emission control line, a first electrode connected to the light emitting device, and a second electrode connected to the third node.

In some exemplary embodiments, the light emitting device is selected from a group comprising an organic light emitting diode and a micro inorganic light emitting diode.

According to another exemplary embodiment of the present disclosure, there is provided a display substrate comprising: a plurality of scan lines for transmitting scan signals; a plurality of light emission control lines for transmitting light emission control signals; a plurality of data lines for transmitting data voltages; and a plurality of pixels arranged in an array, each of the plurality of pixels comprising: a light emitting device; a driving circuit for controlling a magnitude of a driving current supplied from a first power supply to the light emitting device in response to a potential at a first node; a storage capacitor for causing a change in the potential at the first node in response to a change in a potential at a second node, wherein the potential at the second node is switchable between a first reference voltage from a first reference power supply and a data voltage from a corresponding one of the plurality of data lines; and a compensation capacitor for suppressing a change in the driving current caused by a change in the first reference voltage.

In some exemplary embodiments, the display substrate further comprises a substrate on which the plurality of pixels are formed. The driving circuit comprises a driving transistor having a source region, a drain region and an active region formed on the substrate, and a gate region spaced apart from the active region in a vertical direction, the source region and the drain region being spaced apart by the active region. The storage capacitor has a first electrode and a second electrode disposed opposite to each other in the vertical direction. The compensation capacitor has a first electrode and a second electrode disposed opposite to each other in the vertical direction, the first electrode of the compensation capacitor being disposed in a same layer as one of the first electrode and the second electrode of the storage capacitor. The second electrode of the compensation capacitor is formed by a connection wire to the drain region of the driving transistor.

In some exemplary embodiments, the first electrode of the compensation capacitor is disposed in a same layer as the first electrode of the storage capacitor and connected to the first electrode of the storage capacitor.

In some exemplary embodiments, the first electrode of the compensation capacitor is disposed in a same layer as the second electrode of the storage capacitor and connected to the second electrode of the storage capacitor.

In some exemplary embodiments, the connection wire is made of a doped semiconductor material and disposed in a same layer as the active region of the driving transistor.

According to a further exemplary embodiment of the present disclosure, there is provided a display device comprising: the display substrate described above; a first scan driver for supplying the scan signals to the plurality of scan lines; a second scan driver for supplying the light emission control signals to the plurality of light emission control lines; and a data driver for supplying the data voltages to the plurality of data lines.

These and other exemplary embodiments of the present disclosure will be apparent from and elucidated with reference to embodiments described below.

DETAILED DESCRIPTION

Figure 1:
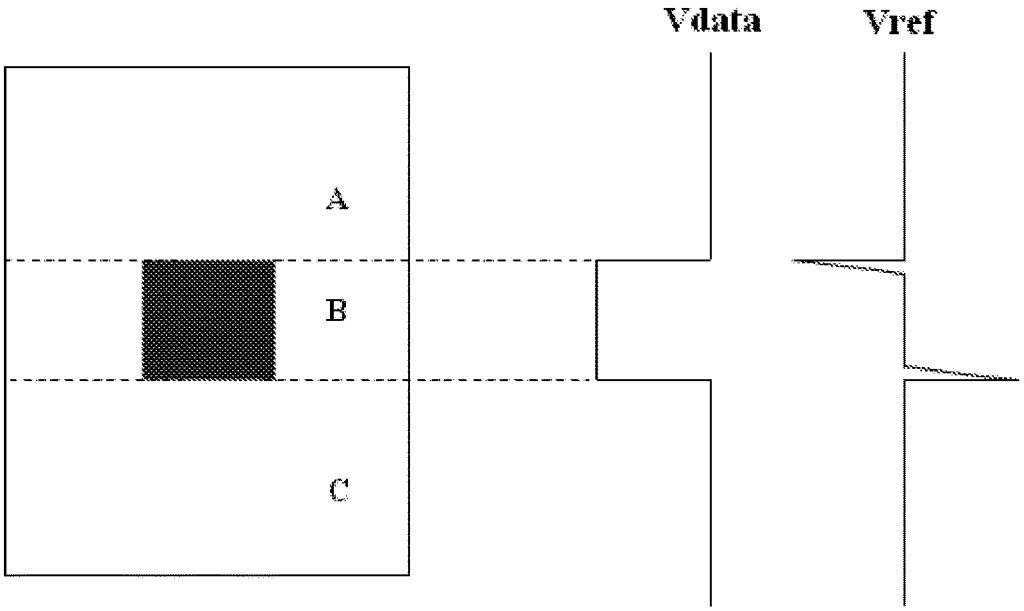
(prior art) FIG.1
FIG. 1 schematically illustrates how crosstalk is generated in a display panel.

It will be understood that, although terms such as "first", "second", "third" and the like may be used herein to describe various elements, components, regions, layers and/or portions, these elements, components, regions, layers and/or portions should not be limited by these terms. These terms are only used to distinguish one element, component, region, layer or portion from another. Thus, a first element, component, region, layer, or portion, which is discussed below, may be referred to as a second element, component, region, layer or portion without departing from the teachings of the disclosure.

Spatially relative terms such as "under", "below", "lower", "beneath", "above", "upper" and the like may be used herein for describing the relationship between one element or feature and another element or feature as illustrated in the drawings for the convenience of description. It will be understood that these spatially relative terms are intended to encompass different orientations of a device in use or operation in addition to the orientations depicted in the drawings. For example, if a device in the drawings is turned over, elements that are described as "below other elements or features" or "under other elements or features" or "beneath other elements or features" will be oriented as "above other elements or features" Thus, exemplary terms "below" and "beneath" may encompass both two orientations of "above" and "below". The device can be oriented in other ways (rotated 90 degrees or in other orientations) and the spatially relative descriptors used herein will be interpreted accordingly. In addition, it will also be understood that when a layer is referred to as "between two layers," it may be a sole layer between the two layers, or one or more intermediate layers may be present.

The terms used herein is only for the purpose of describing particular embodiments and is not intended to limit the present disclosure. As used herein, the singular forms "a", "an" and "the" are intended to also include plural forms, unless explicitly defined otherwise in the context. It will be further understood that the terms "comprising" and/or "including", when used in the specification, specify the presence of a feature, entirety, step, operation, element and/or component involved, but do not exclude the presence or addition of one or more other features, entireties, steps, operations, elements, components, and/or groups thereof. As used herein, the term "and/or" includes any and all combinations of one or more of the associated items listed.

It will be understood that when an element or layer is referred to as "on another element or layer" or "connected to another element or layer" or "coupled to another element or layer," it may be directly on another element or layer, directly connected to another element or layer, or directly coupled to another element or layer, or an intermediate element or layer may be present. In contrast, when an element is referred to as "directly on another element or layer" or "directly connected to another element or layer" or "directly coupled to another element or layer", there is no intermediate element or layer. However, in any case, "on" or "directly on" should not be construed as requiring a layer to completely cover the underlying layer.

Embodiments of the present disclosure will be described herein with reference to illustrations (and intermediate structures) of idealized embodiments of the present disclosure. For this reason, variations in the illustrated shapes should be contemplated as a result of manufacturing techniques and/or tolerances, for example. Thus, embodiments of the present disclosure should not be construed as being limited to the particular shapes of areas illustrated herein, but should include shape variances resulting from fabrication. Therefore, the areas illustrated in the figures are essentially illustrative, and the shapes thereof are not intended to illustrate the actual shapes of the areas of a device and not intended to limit the scope of the present disclosure.

All the terms (including technical and scientific terms) used herein have the same meanings as commonly understood by a person having ordinary skill in the art to which the present disclosure pertains, unless otherwise defined. It will be further understood that terms such as those defined in commonly used dictionaries should be interpreted as having meanings consistent with their meanings in the relevant art and/or context of the specification, and will not be explained in an idealized or too formal sense, unless explicitly defined herein. In order to enable those skilled in the art to better understand the technical solutions of the present disclosure, two elements being "disposed in the same layer" herein may mean that they are formed on the substrate by the same material layer after a patterning process, but does not mean that their distances to the substrate are necessarily equal.

Embodiments of the present disclosure will be described in detail below with reference to the accompanying drawings.

FIG. 1 schematically shows how crosstalk is generated in a display panel. In the display panel, a reference voltage Vref is supplied to all the pixels, which can determine a pixel current for a respective pixel together with a respective data voltage Vdata. As shown in FIG. 1, at the time of scanning from an area A to a pixel located in an area B, and scanning from a pixel located in the area B to an area C, a data voltage Vdata of the pixel will jump, causing a jump in the reference voltage Vref which should be stable. At that time, other pixels in a light emitting phase may suffer from undesired display effect such as flicker, i.e. being affected by crosstalk.

Figure 2:
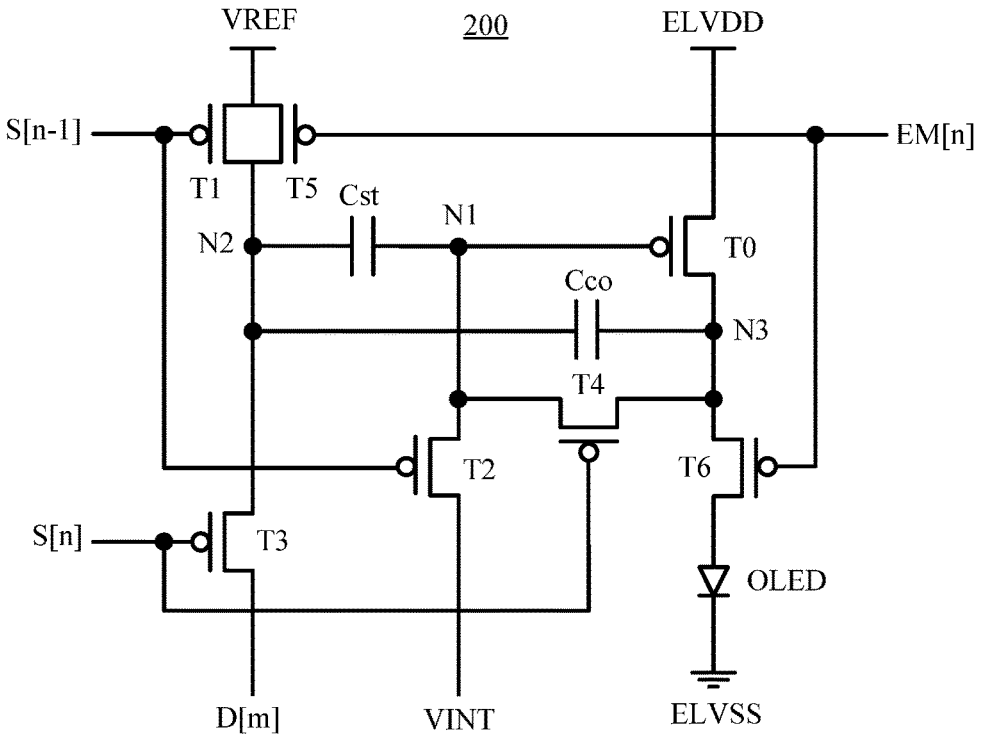
FIG. 2 is a circuit diagram of a pixel circuit according to an embodiment of the present disclosure.

FIG. 2 is a circuit diagram of a pixel circuit 200 according to an embodiment of the present disclosure. As shown in FIG. 2, the pixel circuit 200 comprises a light emitting device (which is an organic light emitting diode OLED in FIG. 2), a driving circuit shown as a driving transistor T0, a storage capacitor Cst, and a compensation capacitor Cco.

The light emitting device, illustrated as an organic light emitting diode OLED, is connected between a first power supply ELVDD and a second power supply ELVSS. The light emitting device is not limited to an organic light emitting diode, and may be other types of light emitting elements such as micro light emitting diode (Micro-LED). As is known, micro light emitting diodes employ inorganic materials as a luminescent material and typically have dimensions on the order of microns.

The driving circuit controls a magnitude of a driving current supplied from the first power supply ELVDD to the light emitting device OLED in response to a potential at a first node N1. In this example, the driving circuit includes the driving transistor T0. Specifically, the driving transistor T0 is connected in series with the light emitting device OLED. More specifically, in this example, the driving transistor T0 is shown as a P-type transistor having a gate connected to the first node N1, a source connected to the first power supply ELVDD, and a drain connected to a third node N3. In other embodiments, the driving circuit may take other forms.

The storage capacitor Cst causes a change in the potential at the first node N1 in response to a change in a potential at a second node N2. Specifically, the storage capacitor Cst is connected between the second node N2 and the first node N1. The potential at the second node N2 may be selectively set at a first reference voltage from a first reference power supply VREF (via a first transistor T1 or a fifth transistor T5) or a data voltage from a data line D[m]. As will be described later, when the pixel circuit 200 is in operation, the potential at the second node N2 switches between the first reference voltage and the data voltage.

The compensation capacitor Cco is used for suppressing a change in the driving current flowing through the light emitting device OLED caused by a change in the first reference voltage. In this example, the compensation capacitor Cco is connected between the second node N2 and the third node N3. The compensation capacitor Cco enables negative feedback control of the potential at the first node N1. For example, in a light emitting phase (wherein the potential at the second node N2 is set at the first reference voltage from the first reference voltage source VREF, as will be described later), when the first reference voltage increases due to, for example, crosstalk, the potential at the second node N2 increases, and the potential at the first node N1 also increases accordingly due to the bootstrap effect of the storage capacitor Cst, that is, a gate-source voltage of the driving transistor T0 increases, which results in a decrease in the driving current of the P-type driving transistor and thus a decrease in the potential at the third node N3. The decrease in the potential at the third node N3 causes a decrease in the potential at the second node N2 due to the bootstrap effect of the compensation capacitor Cco, which in turn causes a decrease in the potential at the first node N1 due to the bootstrap effect of the storage capacitor Cst. Therefore, negative feedback control of the potential at the first node N1 is achieved. Advantageously, this negative feedback control ensures the potential at the first node N1 and thus the relative stability of the gate-source voltage of the driving transistor T0, thereby reducing the effect of crosstalk on the driving current and thus improving the display quality.

Figure 3:
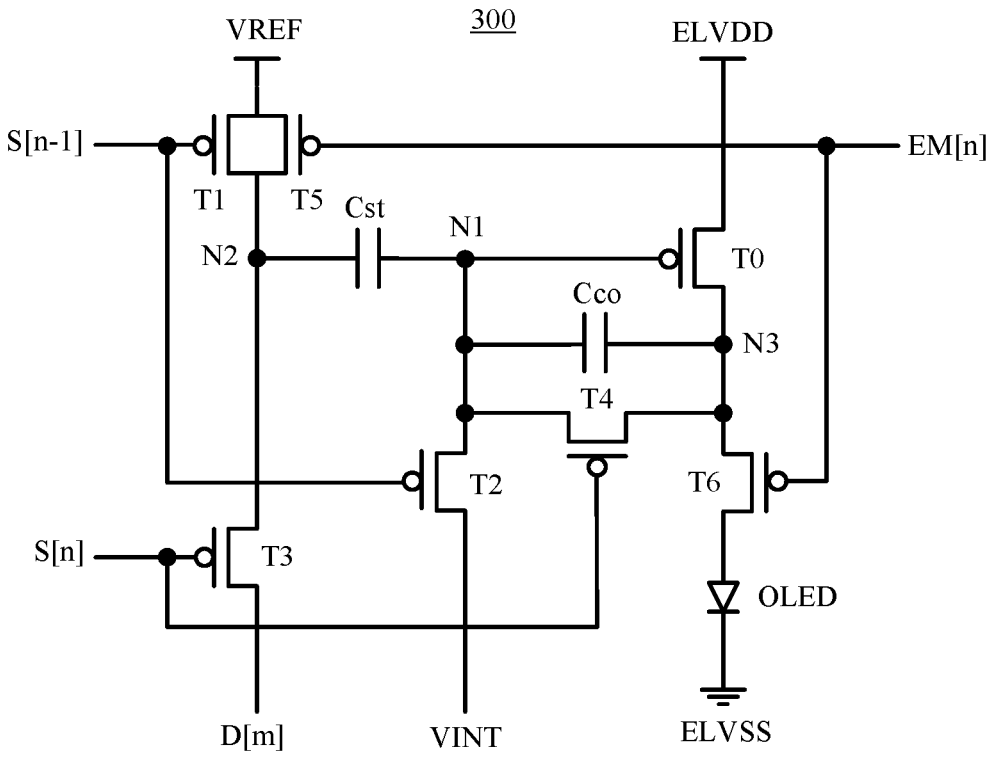
FIG. 3 is a circuit diagram of another pixel circuit according to an embodiment of the present disclosure.

FIG. 3 illustrates a pixel circuit 300 as an alternative to the pixel circuit 200 shown in FIG. 2. As shown in FIG. 3, in the pixel circuit 300, the compensation capacitor Cco is connected between the first node N1 (rather than the second node N2) and the third node N3. The negative feedback control described above is still tenable, except that the compensation capacitor Cco now provides direct negative feedback to the potential at the first node N1 rather than via the storage capacitor Cst.

In the example of FIG. 2 or FIG. 3, the pixel circuits 200 and 300 each further comprise a reset circuit including the first transistor T1 and a second transistor T2, a write circuit including a third transistor T3 and a fourth transistor T4, and a light emission control circuit including a fifth transistor T5 and a sixth transistor T6.

In the reset circuit, the first transistor T1 has a gate connected to a first scan line S[n−1], a first electrode connected to the first reference power supply VREF, and a second electrode connected to the second node N2, and the second transistor T2 has a gate connected to the first scan line S[n−1], a first electrode connected to a second reference power supply VINT, and a second electrode connected to the first node N1. The first transistor T1 is configured to supply the first reference voltage from the first reference power supply VREF to the second node N2 in response to a signal on the first scan line S[n−1] being active. The second transistor T2 is configured to supply a second reference voltage Vint from the second reference power supply VINT to the first node N1 in response to the signal on the first scan line S[n−1] being active.

In the write circuit, the third transistor T3 has a gate connected to a second scan line S[n], a first electrode connected to the data line D[m], and a second electrode connected to the second node N2, and the fourth transistor T4 has a gate connected to the second scan line S[n], a first electrode connected to the first node N1, and a second electrode connected to the third node N3. The third transistor T3 is configured to supply the data voltage from the data line D[m] to the second node N2 in response to a signal on the second scan line S[n] being active. The fourth transistor T4 is configured to bring the first node N1 into conduction with the third node N3 in response to the signal on the second scan line S[n] being active.

In the light emission control circuit, the fifth transistor T5 has a gate connected to a light emission control line EM[n], a first electrode connected to the first reference power supply VREF, and a second electrode connected to the second node N2, and the six transistor T6 has a gate connected to the light emission control line EM[n], a first electrode connected to the light emitting device OLED, and a second electrode connected to the third node N3. The fifth transistor T5 is configured to supply the first reference voltage from the first reference power supply VREF to the second node N2 in response to a signal on the light emission control line EM[n] being active. The sixth transistor T6 is configured to be turned on in response to the signal on the light emission control line EM[n] being active, thereby providing a path allowing the driving current to flow from the first power supply ELVDD to the second power supply ELVSS via the light emitting device OLED and the driving transistor T0.

Figure 4:
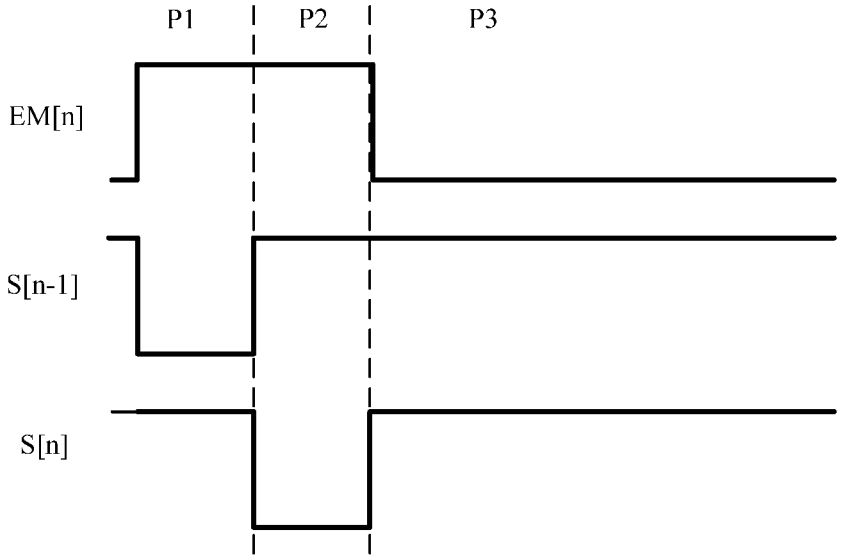
FIG. 4 is a timing diagram of the pixel circuit shown in FIG. 2 or FIG. 3.

FIG. 4 illustrates a timing diagram of the pixel circuit 200 or 300. The operation of the pixel circuit 200 or 300 will be described in detail below with reference to FIG. 4. It is assumed that the first reference power supply VREF supplies a first reference voltage Vref, the second reference power supply VINT supplies a second reference voltage Vint, the first power supply ELVDD supplies a first power supply voltage Vdd, and the second power supply ELVSS supplies a second power supply voltage Vss.

During a reset phase P1, the signal on the first scan line S[n−1] is active, the signal on the second scan line S[n] is inactive, and the signal on the light emission control line EM[n] is inactive. The first transistor T1 and the second transistor T2 are turned on such that the first reference voltage Vref supplied from the first reference voltage source VREF and the second reference voltage Vinit supplied from the second reference voltage source VINT are transmitted to two ends (i.e. the second node N2 and the first node N1) of the storage capacitor Cst respectively. Therefore, the voltage across the storage capacitor Cst is reset. The first reference voltage Vref and the second reference voltage Vint may be equal or unequal as long as the driving transistor T0 is not turned on. In general, the difference between Vref and Vint should not be too large to avoid overcharge of the storage capacitor Cst.

During a writing phase P2, the signal on the first scan line S[n−1] is inactive, the signal on the second scan line S[n] is active, and the signal on the light emission control line EM[n] is inactive. The third transistor T3 is turned on to transmit the data voltage Vdata on the data line D[m] to the second node N2. At the same time, the fourth transistor T4 is also turned on to bring the first node N1 into conduction with the third node N3. Therefore, the driving transistor T0 is in a diode-connecting state in which its gate-source voltage Vgs is equal to its threshold voltage Vth. Since the source voltage Vs of the driving transistor T0 is the first power supply voltage Vdd supplied from the first power supply ELVDD, the gate voltage Vg (i.e. the potential at the first node N1) thereof is (Vdd+Vth).

During a light emitting phase P3, the signal on the first scan line S[n−1] is inactive, the signal on the second scan line S[n] is inactive, and the signal on the light emission control line EM[n] is active. The fifth transistor T5 is turned on to transmit the first reference voltage Vref supplied from the first reference voltage source VREF to the second node N2. Therefore, the potential at the second node N2 jumps from Vdata in the writing phase P2 to Vref, and the variation is (Vref−Vdata). Due to the bootstrap effect of the storage capacitor Cst, the potential at the first node N1 also undergoes the same degree of change, that is, it becomes (Vdd+Vth+Vref−Vdata). At the same time, the sixth transistor T6 is also turned on, providing a current flow path from the first power supply ELVDD to the second power supply ELVSS. The driving current Id flowing through the light emitting device OLED is calculated as:

$$\begin{aligned} Id &= K(Vgs-Vth)^2 \\ &= K(Vdd+Vth+Vref-Vdata-Vdd-Vth)^2 \\ &= K(Vref-Vdata)^2 \end{aligned} \quad (1)$$

where K is a predetermined coefficient, which may typically be considered to be a constant. As can be seen from equation (1), the driving current Id is related to the reference voltage Vref supplied from the first reference power supply VREF. Therefore, the jump in the reference level Vref resulting from crosstalk may cause corresponding changes in the driving current Id and thus in the luminance of the light emitting device OLED, which affects the display effect. However, as described above, in the pixel circuit 200 or 300, the change in the driving current Id caused by the change in the reference level Vref is suppressed by providing the compensation capacitor Cco, thereby reducing the impact of crosstalk.

It will be understood that although the transistors are illustrated and described as P-type transistors in the above-described embodiments, N-type transistors are possible. In the case of an N-type transistor, the gate-on voltage has a high level, and the gate-off voltage has a low level. As an example, the transistors may be thin film transistors that are typically fabricated such that their first and second electrodes are used interchangeably.

Figure 5:
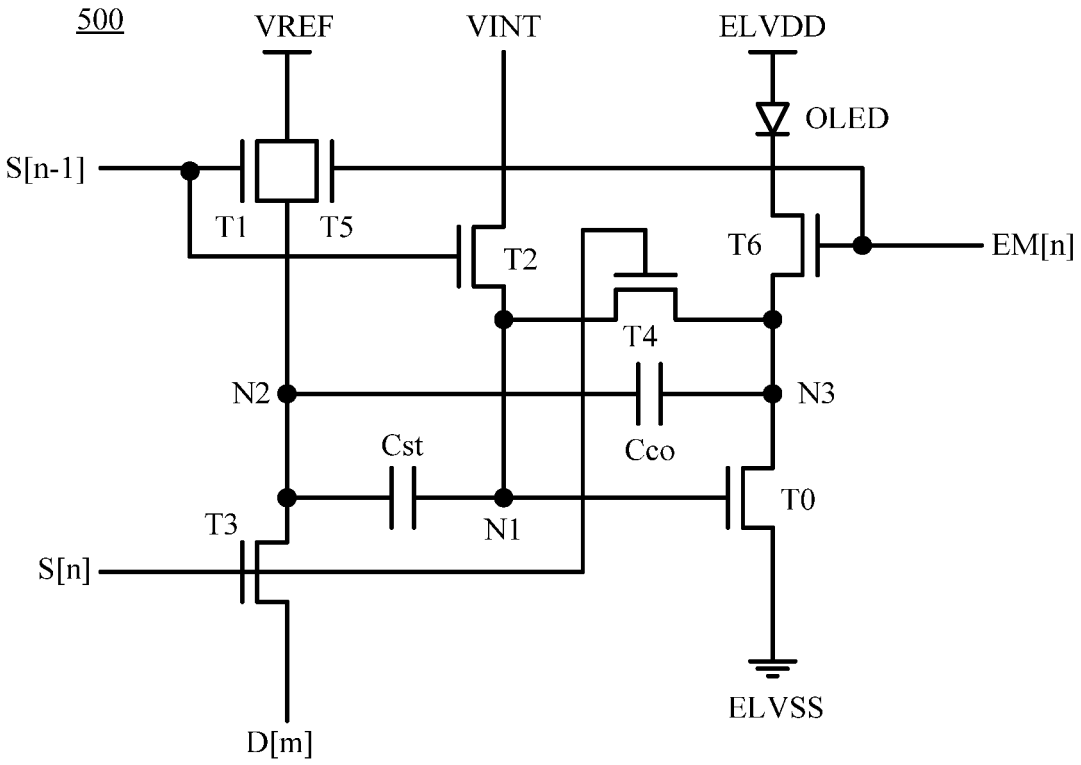
FIG. 5 is a circuit diagram of a further pixel circuit according to an embodiment of the present disclosure.

FIG. 5 illustrates one possible pixel circuit 500 in which each transistor is an N-type transistor. In FIGS. 2, 3 and 5, the same reference numerals denote the same elements. The configuration of the pixel circuit 500 is similar to those of the pixel circuit 200 previously described with respect to FIGS. 2 and 4, except that in the pixel circuit 500, the driving transistor T0 is connected between the third node N3 and the second power supply ELVSS (its drain is connected to the third node N3 and its source is connected to the second power supply ELVSS), and the light emitting device OLED is connected between the first power supply ELVDD and the third node N3. Alternatively, similar to the pixel circuit 300, the compensation capacitor Cco in the pixel circuit 500 may be connected between the first node N1 and the third node N3.

It will also be understood that the concept of the present disclosure is not only applicable to the pixel circuits 200, 300 and 500, but is applicable to any other specific pixel circuit as long as its light emitting device, storage capacitor, driving circuit, and compensation capacitor follow the requirements described herein.

Figure 6:
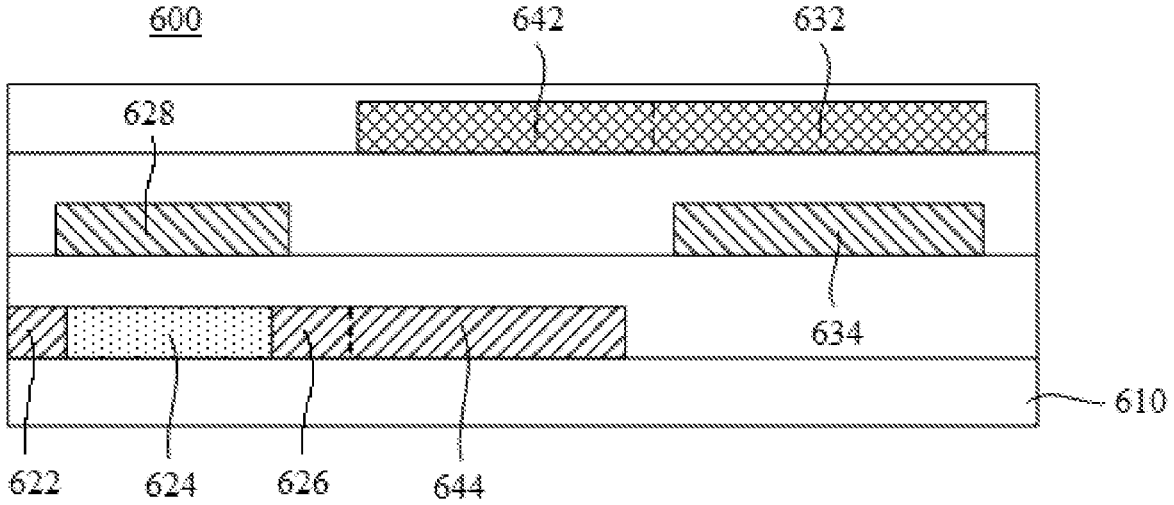
FIG. 6 schematically illustrates a partial sectional view of a display substrate according to an embodiment of the present disclosure.

FIG. 6 illustrates a partial sectional view of a display substrate 600 according to an embodiment of the present disclosure. A substrate 610 is shown in FIG. 6. What are formed on the substrate 610 are a source region 622, an active region 624, and a drain region 626 of the driving transistor T0, wherein the source region 622 and the drain region 626 are spaced apart by the active region 624. The driving transistor T0 further has a gate region 628 that is vertically spaced apart from the active region 624. FIG. 6 further shows a storage capacitor Cst having a first electrode 632 and a second electrode 634 disposed opposite to each other in the vertical direction, and a compensation capacitor Cco having a first electrode 642 and a second electrode 644 disposed opposite to each other in the vertical direction.

The arrangement shown in FIG. 6 corresponds to the pixel circuit 200 shown in FIG. 2, although other elements than the driving transistor T0, the storage capacitor Cst, and the compensation capacitor Cco are not shown for the convenience of illustration. In the example of FIG. 6, the second electrode 644 of the compensation capacitor Cco is disposed in the same layer as the drain region 626 of the driving transistor T0, and is formed of a connection wire for coupling the drain region 626 to other elements (which is the sixth transistor T6 in the pixel circuit 200) in the pixel circuit. It may be advantageous to use the connection wire as the second electrode 644 of the compensation capacitor Cco, because the second electrode 644 can then be located within a layout area of the original pixel circuit (i.e. the pixel circuit without the compensation capacitor Cco), such that the presence of the compensation capacitor Cco would not increase the layout area of the pixel circuit, thereby improving the resolution. This can also eliminate the need for additional wires, thereby reducing crosstalk resulting from, for example, wire overlap.

Further, the first electrode 642 of the compensation capacitor Cst is disposed in the same layer as the first electrode 632 of the storage capacitor Cst, and the electrodes 642 and 632 may or may not be directly connected to each other. In the former case, the first electrode 632 may have an extension portion corresponding to the second electrode 644 as the first electrode 642, wherein the extension portion and the connection wire 644 constitute a compensation capacitor Cco. In this way, it is not necessary to add a preparation process for forming the compensation capacitor Cco, thereby simplifying the process.

Figure 7:
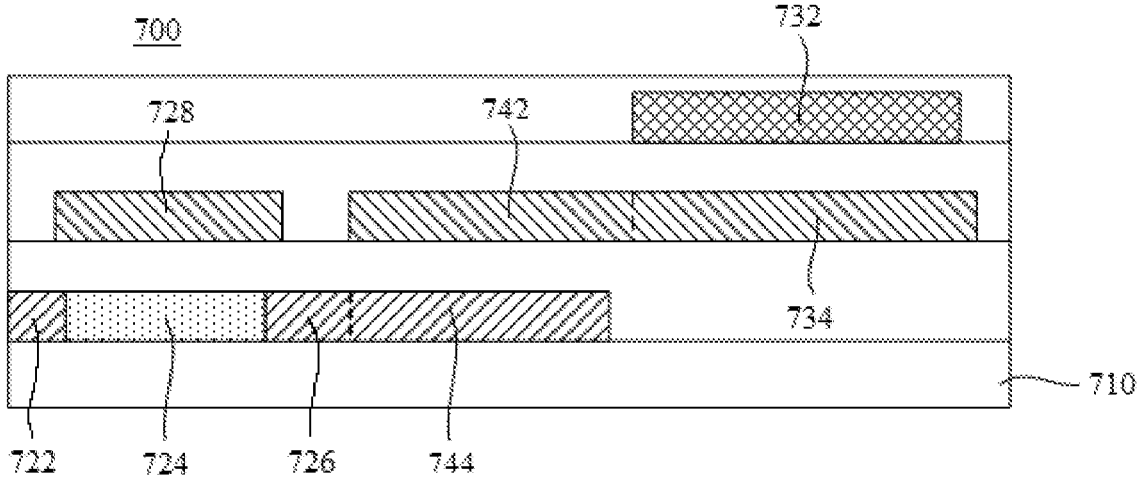
FIG. 7 schematically illustrates a partial sectional view of another display substrate according to an embodiment of the present disclosure.

FIG. 7 illustrates a partial sectional view of another display substrate 700 according to an embodiment of the present disclosure. A substrate 710 is shown in FIG. 7. Similar to the configuration shown in FIG. 6, what are formed on the substrate 710 are a source region 722, an active region 724, a drain region 726, and a gate region 728 of the driving transistor T0. FIG. 7 also shows a storage capacitor Cst having a first electrode 732 and a second electrode 734 and a compensation capacitor Cco having a first electrode 742 and a second electrode 744.

The display substrate 700 is different from the display substrate 600 in that the display substrate 700 corresponds to the pixel circuit 300 shown in FIG. 3. As shown in FIG. 7, the first electrode 742 of the compensation capacitor Cco is disposed in the same layer as the second electrode 734 of the storage capacitor Cst. Other configurations of the display substrate 700 may be the same as those of the display substrate 600 previously described with respect to FIG. 6, and are thus omitted here for the sake of brevity.

In the display substrate 600 or 700, the second electrode 634 or 734 of the storage capacitor Cst is illustrated as being disposed in the same layer as the gate region 628 or 728 of the driving transistor T0, though the present disclosure is not so limited. For example, the second electrode 634 or 734 may be disposed in the same layer as other structures (such as the source/drain of the driving transistor) of the pixel circuit. As another example, the second electrode 634 or 734 can be directly connected to the gate region 628 or 728 of the driving transistor T0.

In the display substrate 600 or 700, the connection wire serving as the second electrode 644 or 744 of the storage capacitor Cco may be made of a doped semiconductor material. In one implementation, when the active region 624 or 724 of the driving transistor T0 is being formed, the semiconductor layer is also left outside the active region and doped (e.g. lightly doped) so that it has good conductivity. Thus, the doped semiconductor layer may be used as a connection wire, i.e. the second electrode 644 or 744.

It will be understood that although not indicated in FIG. 6 or 7, an insulating layer is present between the gate region 728 and the active region 724, between the first electrode and the second electrode of storage capacitor Cst, and between the first electrode and the second electrode of the compensation capacitor Cco, the detailed description of which is omitted here for the sake of brevity.

Figure 8:
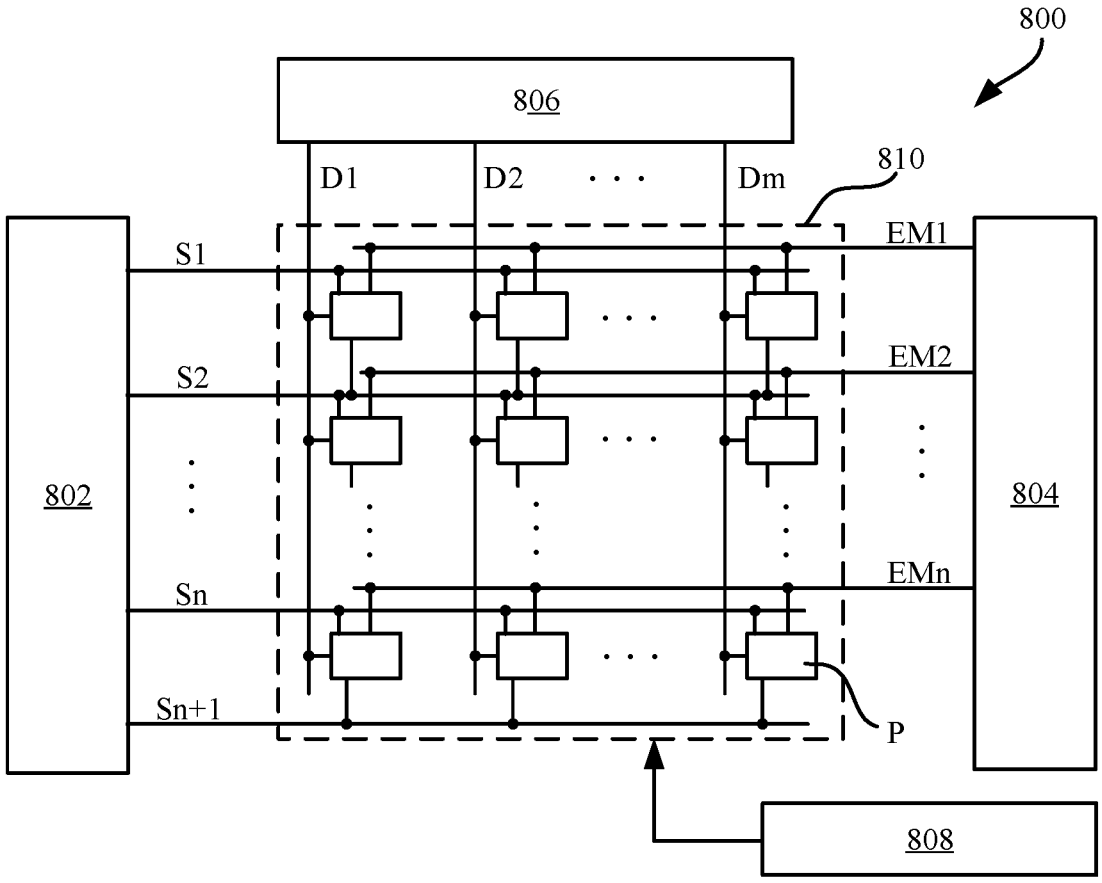
FIG. 8 is a block diagram of a display device according to an embodiment of the present disclosure.

FIG. 8 is a block diagram of a display device 800 according to an embodiment of the present disclosure. Referring to FIG. 8, the display device 800 comprises a display substrate 810, a first scan driver 802, a second scan driver 804, a data driver 806, and a voltage generator 808.

The display substrate 810 includes n×m pixels P. Each pixel P may take the form of, for example, the pixel circuit 200, 300 or 500 previously described with respect to FIGS. 2 to 5. The display substrate 810 includes n+1 scan lines S1, S2, . . . , Sn, Sn+1 arranged in a first direction (the row direction in the figure) to transmit scan signals; m data lines D1, D2, . . . , Dm arranged in a second direction (the column direction in the figure) crossing the first direction to transmit data signals; n light emission control lines EM1, EM2, . . . , EMn arranged in the first direction to transmit light emission control signals; and wires (not shown) for applying the first and second power supply voltages Vdd, Vss and the first and second reference voltages Vref, Vinit. n and m are natural numbers.

The first scan driver 802 is connected to the scan lines S1, S2, . . . , Sn, Sn+1 to apply the scan signals to the display substrate 810.

The second scan driver 804 is connected to the light emission control lines EM1, EM2, . . . , EMn to apply the light emission control signals to the display substrate 810.

The data driver 806 is connected to the data lines D1, D2, . . . , Dm to apply the data signals to the display substrate 810. Here, the data driver 106 supplies the data voltage to the respective pixels P in the display substrate 810 during the writing phase P2, as described previously with respect to FIG. 4.

The voltage generator 808, which can function as the first power supply ELVDD, the second power supply ELVSS, the first reference power supply VREF and the second reference power supply VINT as described in the foregoing embodiments, generates the first power supply voltage Vdd, the second power supply voltage Vss, the first reference voltage Vref, and the second reference voltage Vinit each pixel P needs. Examples of voltage generator 808 include, but are not limited to, a DC/DC converter and a low dropout regulator (LDO).

The display device 800 may be any product or component having a display function such as a display panel, an electronic paper, a mobile phone, a tablet computer, a television, a display, a notebook computer, a digital photo frame, a navigator, and the like.

While the present disclosure has been illustrated and described in the drawings and the foregoing description, such illustration and description shall be construed as being illustrative and schematic, rather than limiting. The present disclosure is not limited to the embodiments disclosed.

The invention claimed is:

1. A pixel circuit comprising:

a light emitting device;

a driving circuit for controlling a magnitude of a driving current supplied from a first power supply to the light emitting device in response to a potential at a first node;

a storage capacitor for causing a change in the potential at the first node in response to a change in a potential at a second node, wherein the potential at the second node is switchable between a first reference voltage from a first reference power supply and a data voltage from a data line; and a compensation capacitor for suppressing a change in the driving current caused by a change in the first reference voltage, wherein the light emitting device is connected between the first power supply and a second power supply;

the driving circuit comprises a driving transistor connected in series with the light emitting device, wherein the driving transistor has a gate connected to the first node;

the storage capacitor is connected between the second node and the first node; and the compensation capacitor is connected between a third node and one of the first node and the second node.

2. The pixel circuit according to claim 1, wherein the driving transistor is a P-type transistor connected between the first power supply and the third node, and wherein the light emitting device is connected between the third node and the second power supply.

3. The pixel circuit according to claim 1, wherein the driving transistor is an N-type transistor connected between the third node and the second power supply, and wherein the light emitting device is connected between the first power supply and the third node.

4. The pixel circuit according to claim 1, further comprising:

a reset circuit configured to supply the first reference voltage from the first reference power supply to the second node and supply a second reference voltage from a second reference power supply to the first node in response to a signal on a first scan line being active;

a write circuit configured to supply the data voltage from the data line to the second node and bring the first node into conduction with the third node in response to a signal on a second scan line being active; and a light emission control circuit configured to, in response to a signal on a light emission control line being active, supply the first reference voltage from the first reference power supply to the second node and provide a path allowing the driving current to flow from the first power supply to the second power supply via the light emitting device and the driving transistor.

5. The pixel circuit according to claim 4, wherein the reset circuit comprises:

a first transistor having a gate connected to the first scan line, a first electrode connected to the first reference power supply, and a second electrode connected to the second node; and a second transistor having a gate connected to the first scan line, a first electrode connected to the second reference power supply, and a second electrode connected to the first node.

6. The pixel circuit according to claim 4, wherein the write circuit comprises:

a third transistor having a gate connected to the second scan line, a first electrode connected to the data line, and a second electrode connected to the second node; and a fourth transistor having a gate connected to the second scan line, a first electrode connected to the first node, and a second electrode connected to the third node.

7. The pixel circuit according to claim 4, wherein the light emission control circuit comprises:

a fifth transistor having a gate connected to the light emission control line, a first electrode connected to the first reference power supply, and a second electrode connected to the second node; and a sixth transistor having a gate connected to the light emission control line, a first electrode connected to the light emitting device, and a second electrode connected to the third node.

8. The pixel circuit according to claim 1, wherein the light emitting device is selected from a group comprising an organic light emitting diode and a micro inorganic light emitting diode.

9. A display substrate comprising:

a plurality of scan lines for transmitting scan signals;

a plurality of light emission control lines for transmitting light emission control signals;

a plurality of data lines for transmitting data voltages;

a plurality of pixels arranged in an array; and a substrate on which the plurality of pixels are formed, wherein each of the plurality of pixels comprises:

a light emitting device;

a driving circuit for controlling a magnitude of a driving current supplied from a first power supply to the light emitting device in response to a potential at a first node;

a storage capacitor for causing a change in the potential at the first node in response to a change in a potential at a second node, wherein the potential at the second node is switchable between a first reference voltage from a first reference power supply and a data voltage from a corresponding one of the plurality of data lines; and a compensation capacitor for suppressing a change in the driving current caused by a change in the first reference voltage, wherein the driving circuit comprises a driving transistor having a source region, a drain region and an active region formed on the substrate, and a gate region spaced apart from the active region in a vertical direction, the source region and the drain region being spaced apart by the active region, wherein the storage capacitor has a first electrode and a second electrode disposed opposite to each other in the vertical direction, wherein the compensation capacitor has a first electrode and a second electrode disposed opposite to each other in the vertical direction, the first electrode of the compensation capacitor being disposed in a same layer as one of the first electrode and the second electrode of the storage capacitor, and wherein the second electrode of the compensation capacitor is formed by a connection wire to the drain region of the driving transistor.

10. The display substrate according to claim 9, wherein the first electrode of the compensation capacitor is disposed in a same layer as the first electrode of the storage capacitor and connected to the first electrode of the storage capacitor.

11. The display substrate according to claim 9, wherein the first electrode of the compensation capacitor is disposed in a same layer as the second electrode of the storage capacitor and connected to the second electrode of the storage capacitor.

12. The display substrate according to claim 9, wherein the connection wire is made of a doped semiconductor material and disposed in a same layer as the active region of the driving transistor.

13. A display device comprising:

the display substrate according to claim 9;

a first scan driver for supplying the scan signals to the plurality of scan lines;

a second scan driver for supplying the light emission control signals to the plurality of light emission control lines; and a data driver for supplying the data voltages to the plurality of data lines.

14. The display device according to claim 13, wherein the first electrode of the compensation capacitor is disposed in a same layer as the first electrode of the storage capacitor and connected to the first electrode of the storage capacitor.

15. The display device according to claim 13, wherein the first electrode of the compensation capacitor is disposed in a same layer as the second electrode of the storage capacitor and connected to the second electrode of the storage capacitor.

16. The display device according to claim 13, wherein the connection wire is made of a doped semiconductor material and disposed in a same layer as the active region of the driving transistor.

* * * * *